US010998156B2

(12) United States Patent
Delpozzo et al.

(10) Patent No.: US 10,998,156 B2
(45) Date of Patent: May 4, 2021

(54) AUXILIARY/CONTROL SWITCHES KIT BOX FOR A MEDIUM VOLTAGE SWITCHING DEVICE

(71) Applicant: ABB Schweiz AG, Baden (CH)

(72) Inventors: Andrea Delpozzo, Torbiato di Adro (IT); Emanuele Morelli, Linarolo (IT); Gabriele Gasparini, Bergamo (IT); Osvaldo Prestini, Nembro (IT)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 16/636,454

(22) PCT Filed: Jul. 16, 2018

(86) PCT No.: PCT/EP2018/069281

§ 371 (c)(1),
(2) Date: Feb. 4, 2020

(87) PCT Pub. No.: WO2019/034350

PCT Pub. Date: Feb. 21, 2019

(65) Prior Publication Data

US 2020/0321179 A1 Oct. 8, 2020

(30) Foreign Application Priority Data

Aug. 14, 2017 (EP) ..... 17186114

(51) Int. Cl.
*H01H 71/02* (2006.01)
*H01H 71/10* (2006.01)
*H01H 71/46* (2006.01)

(52) U.S. Cl.
CPC ..... *H01H 71/0207* (2013.01); *H01H 71/10* (2013.01); *H01H 71/465* (2013.01)

(58) Field of Classification Search
CPC ... H01H 71/0207; H01H 71/10; H01H 71/465
(Continued)

(56) References Cited

U.S. PATENT DOCUMENTS 5,440,088 A * 8/1995 Coudert ..... H01H 71/465 200/303
2012/0320487 A1* 12/2012 Cortinovis ..... H01R 13/504 361/115
2017/0358412 A1* 12/2017 Delpozza ..... H01H 3/30

FOREIGN PATENT DOCUMENTS

EP 2346060 A1 7/2011
EP 3258473 A1 12/2017
(Continued)

OTHER PUBLICATIONS

European Patent Office, International Search Report & Written Opinion issued in corresponding Application No. PCT/EP2018/069281, dated Oct. 16, 2018, 17 pp.
(Continued)

*Primary Examiner* — Edwin A. Leon
*Assistant Examiner* — Iman Malakooti
(74) *Attorney, Agent, or Firm* — Taft Stettinius & Hollister LLP

(57) ABSTRACT

An auxiliary/control switches kit box for a Medium Voltage switching device including one or more movable contacts operated between a contact open position and a contact closed position by a kinematic chain connected to a contact actuator. The auxiliary/control switches kit box includes: a shaped enclosure adapted to be inserted into and removed from a dedicated volume inside the Medium Voltage switching device; the shaped enclosure housing one or more auxiliary/control switches electrically connected to corresponding one or more terminal boards; the one or more terminal boards facing toward the outside of the shaped enclosure from a first face of the shaped enclosure; the one or more auxiliary/control switches each including a pair of auxiliary/control switch contacts that can be linearly operated by an auxiliary/control switch actuator between a normally open (NO) position and a normally closed (NC)
(Continued)

position; a mechanical coupling system mechanically connected to the auxiliary/control switch actuator to linearly displace it between the NO position and the NC position; the mechanically coupling system having one or more operating levers protruding outside the shaped enclosure from a second face thereof and being adapted to cooperate with the kinematic chain of the Medium Voltage switching device and follow it during the movement from the contact open position and the contact closed position.

20 Claims, 10 Drawing Sheets

(58) Field of Classification Search
USPC ..... 200/335
See application file for complete search history.

(56) References Cited

FOREIGN PATENT DOCUMENTS

| | | | |
|---|---|---|---|
| EP | 3301700 | A1 | 4/2018 |
| EP | 3321950 | A1 | 5/2018 |
| WO | 2009095330 | A1 | 8/2009 |

OTHER PUBLICATIONS

European Patent Office, Extended Search Report issued in corresponding Application No. 17186114.9, dated Mar. 12, 2018, 10 pp.

* cited by examiner

AUXILIARY/CONTROL SWITCHES KIT BOX FOR A MEDIUM VOLTAGE SWITCHING DEVICE

The present invention relates to an auxiliary/control switches kit box for a Medium Voltage switching device, in particular for a Medium Voltage contactor, more in particular for a Medium Voltage vacuum contactor.

For the purpose of the present application, the term "medium voltage" (MV) relates to operating voltages at electric power distribution levels, which are higher than 1 kV AC and 1.5 kV DC up to some tens of kV, e.g. up to 72 kV AC and 100 kV DC.

As is known, Medium Voltage electric systems typically adopt two different kinds of switching devices.

A first type of switching devices, including for example circuit breakers, is basically designed for protection purposes, namely for carrying (for a specified time interval) and breaking currents under specified abnormal circuit conditions, e.g. under short circuit conditions.

A second type of switching devices, including for example contactors, is basically designed for manoeuvring purposes, namely for carrying and breaking currents under normal circuit conditions including overload conditions. MV vacuum contactors represent a widely used type of MV contactors.

It is also known that Medium Voltage mechanical switching devices (e.g. circuit breakers, contactors, disconnectors, and similar devices) are generally equipped with the so called Auxiliary Switches which—according to the IEV 441-15-11—are "a switch containing one or more control and/or auxiliary contacts mechanically operated by a switching device" and/or with the so called Control Switches which—according to the IEV 441-14-46—are "mechanical switching device which serves the purpose of controlling the operation of switchgear or control gear, including signalling, electrical interlocking, etc."

Among others, the most common Auxiliary (or Control) Switches are those indicating the open/close status of the main switching device (i.e., the Make and Break contacts according to IEV 441-15-12 and 441-15-13]. It means that they are normally open (NO) in case of main device open and normally closed (NC) in case of main device closed (or vice versa).

These auxiliary switches are generally grouped in a set of a number "n" of switches (NC+NO) and linked to the main switch mechanism kinematics.

From an operative standpoint, the opening/closing of the auxiliary/control switches is driven by the opening/closing of the main switch mechanism of the Medium Voltage mechanical switching device.

In general, the operability of an auxiliary/control switch system must fulfil the requirements of existing Standards. For instance, according to IEC 62271-1 and derived Standards, an auxiliary switch operated in conjunction with the main contacts of a switching device shall be positively driven in both opening and closing directions. The standard also defines 3 classes of aux switches according to their breaking capacity, where class 1 has the highest performances.

In addition to the requirements of the Standards, the auxiliary/control switch systems should also meet the market requirements, as well as manufacturing and maintenance issues For instance, a set of auxiliary/control switches mounted on a Medium Voltage switching device should be easily mounted on the main switching device by the manufacturer, should be easily wired, and easily accessible/replaceable for service/maintenance activities. Also, the direct access to the auxiliary/control switches terminals by the final user is anyway not recommended and it is preferable to provide access to the customer only via terminal board interface.

Within the broad family of Medium Voltage switching device, the Medium Voltage contactor, and in particular the Medium Voltage vacuum contactors, represent a particular case, since their main switching mechanism generally operate with small strokes and small operating energies compared to circuit-breakers or other kind of switches.

A first family of known kinds of auxiliary/control switches is represented by the Rotating auxiliary switches which however are hardly suitable for applications on Medium Voltage contactor, due to the need of high rotational strokes and therefore dedicated levers kinematics that may have an impact on the actuating force of the main drive, especially where high breaking class is required (and therefore with high auxiliary switch stroke).

A second family of auxiliary/control switches is represented by the Linear auxiliary switches which are instead easily operated by, e.g., Medium Voltage vacuum contactor. However, the state-of art solutions require a fine stroke adjustment by the manufacturer during the assembling phase, that is time consuming and reduces the reliability of the system.

The main aim of the present invention is to provide an auxiliary/control switches system for a Medium Voltage switching device, in particular for a Medium Voltage contactor, more in particular for Medium Voltage vacuum contactor, that allows solving or mitigating the above-mentioned problems.

More in particular, it is an object of the present invention to provide an auxiliary/control switches system for a Medium Voltage switching device, in particular for a Medium Voltage contactor, more in particular for Medium Voltage vacuum contactor, with requires low assembling time and complexity.

As a further object, the present invention is aimed at providing an auxiliary/control switches system for a Medium Voltage switching device, in particular for a Medium Voltage contactor, more in particular for Medium Voltage vacuum contactor, that can be easily installed on said switching device and easily removed therefrom for maintenance and replacement during service.

As a further object, the present invention is aimed at providing an auxiliary/control switches system for a Medium Voltage switching device, in particular for a Medium Voltage contactor, more in particular for Medium Voltage vacuum contactor, that does not have any need of stroke adjustment or set-up during installation.

As a further object, the present invention is aimed at providing an auxiliary/control switches system for a Medium Voltage switching device, in particular for a Medium Voltage contactor, more in particular for Medium Voltage vacuum contactor, that is applicable on switching devices with small contact stroke, such as Medium Voltage vacuum contactors, with no need of multiple levers transmission.

Still a further of the present invention is to provide an auxiliary/control switches system for a Medium Voltage switching device, in particular for a Medium Voltage contactor, more in particular for Medium Voltage vacuum contactor, in which the end-users do not have direct access to the auxiliary/control switches terminals.

Yet a further of the present invention is to provide an auxiliary/control switches system for a Medium Voltage switching device, in particular for a Medium Voltage contactor, more in particular for Medium Voltage vacuum contactor, which does not require the presence of springs or similar actuating systems for the switching operation thereof.

Still another object of the present invention is to provide an auxiliary/control switches system for a Medium Voltage switching device, in particular for a Medium Voltage contactor, more in particular for Medium Voltage vacuum contactor, that can be easily manufactured at industrial level, at competitive costs with respect to the solutions of the state of the art.

In a further aspect, the present invention also relates to a Medium Voltage switching device, in particular a Medium Voltage contactor, more in particular a Medium Voltage vacuum contactor, comprising an auxiliary/control switches as described herein.

In order to fulfill these aim and objects, the present invention provides an auxiliary/control switches kit box for a Medium Voltage switching device comprising one or more movable contacts operated between a contact open position and a contact closed position by a kinematic chain connected to a contact actuator. The auxiliary/control switches kit box according to the present invention is characterized in that it comprises: a shaped enclosure adapted to be inserted into and removed from a dedicated volume inside said Medium Voltage switching device; said shaped enclosure housing one or more auxiliary/control switches electrically connected to corresponding one or more terminal boards; said one or more terminal boards facing toward the outside of said shaped enclosure from a first face of said shaped enclosure; said one or more auxiliary/control switches each comprising a pair of auxiliary/control switch contacts that can be linearly operated by an auxiliary/control switch actuator between a normally open (NO) position and a normally closed (NC) position; the auxiliary/control switches kit box further comprising a mechanical coupling system mechanically connected to said auxiliary/control switch actuator to linearly displace it between said NO position and said NC position; said mechanically coupling system having one or more operating levers protruding outside said shaped enclosure from a second face thereof and being adapted to cooperate with the kinematic chain of said Medium Voltage switching device and follow it during the movement from said contact open position and said contact closed position.

In this way, it is possible to provide a kit of auxiliary/control switches with "plug & play" capabilities that overcomes the problems and drawbacks of the existing systems of auxiliary/control switches.

In practice, with the system of the present invention, the auxiliary/control switches can be pre-wired in factory with the terminal board, and the full assembly of switches and terminal boards is included in a box, e.g., a plastic box. Also, the fixation of the box to the frame of the Medium Voltage switching device can be done either by means of screw means or by alternative fastening methods (e.g., snap-fit fixing, sliding surface joints, and similar quick fixing systems). The assembling time and assembling complexity are therefore greatly reduced and the kit box can be easily installed, and is also easily removable for maintenance and replacement during service.

Moreover, there is no need of stroke adjustment or set-up at the site, and installation as well as service and maintenance activities can be easily done on-site without the intervention of the manufacturer.

In addition, since the operating levers of the auxiliary/control switches are located on one side of the box while the terminal board lays on a different side, the end-users can have easy access to the terminal board of the box positioned, e.g., on the front of the Medium Voltage switching device, without direct access to the auxiliary/control switches terminals, thereby greatly improving the safety of the system.

The auxiliary/control switches kit box is particularly useful in conjunction with Medium Voltage contactors, in particular Medium Voltage vacuum contactors, and other switching devices with small contact stroke, since it requires only small displacements to be operated, thereby avoiding any need of multiple levers transmission.

As better explained in the following description, a linear movement, e.g. vertical movement, of the drive kinematics of the Medium Voltage switching device during opening/closing operation thereof, positively drives the movement of the operating levers of the auxiliary/control switches that open/close accordingly. Consequently, the switching of the auxiliary/control switches is always positively driven in both directions, i.e. there is no need of spring or similar means to drive one of the switching directions.

In a preferred embodiment of the auxiliary/control switches kit box, according to the present invention, said one or more auxiliary/control switches are double break switches. Double break switches and micro switches are well known in the art and will not be described in details.

In general such switches comprise a casing into which corresponding auxiliary/control switch contacts are housed (e.g., NC and NO switches). An auxiliary/control switch actuator is operatively connected to the auxiliary/control switch contacts to drive the commutation of, e.g., the NC and NO switches included in the casing.

In the auxiliary/control switches kit box of the present invention, each of said double break switches is associated with at least a corresponding operating lever which is operatively connected to the auxiliary/control switch actuator. Said operating lever is adapted to be operatively connected to the kinematic chain of the Medium Voltage switching device into which the auxiliary/control switches kit box is placed.

For instance, the one or more auxiliary/control switches can be conventional double break switches having a switch actuator which comprises a linearly moving driving pin acting on the auxiliary/control switch contacts to commute their position. The driving pin is connected to and operated by a corresponding operating lever, in turn operated by the kinematic chain of the Medium Voltage switching device.

In this way it is possible to achieve a positive driving of the auxiliary/control switch contacts in both directions, since they are always connected to and follow the kinematic chain of the Medium Voltage switching device.

Moreover, since the driving pin of the double break switches has a small operating stroke, it can be operated by the kinematics of the Medium Voltage switching device, even if it has relatively low displacements, without any need of multiple levers transmission or similar systems of stroke enhancement.

In a particularly preferred embodiment of the auxiliary/control switches kit box of the present invention, the terminals boards and the operating levers respectively protrude outside the shaped enclosure from a first and second face of said shaped enclosure which are substantially opposite to each other.

In this way, the kit box of the present invention can be inserted, e.g., horizontally, in a dedicate volume inside the Medium Voltage switching device so that the operating levers con couple with the kinematic chain of the Medium Voltage switching device. At the same time, since the terminals boards remain are positioned on an opposite side of the shaped enclosure, they lay on the front side of Medium Voltage switching device, thereby being easily accessible by the operators.

The auxiliary/control switches kit box is also endowed with a high flexibility of us. Indeed, the number of auxiliary/control switches positioned inside the shaped enclosure, as well as their layout inside the shaped enclosure, can vary depending on the needs. In general, for most applications, the shaped enclosure houses a set of two or more linearly actuated auxiliary/control switches.

In a preferred embodiment of the auxiliary/control switches kit box of the present invention, the shaped enclosure is provided with snap-fitting means and/or sliding means and/or fixing means for guiding the insertion of said auxiliary/control switches kit box inside the dedicated volume of said Medium Voltage switching device and/or for fixing said shaped enclosure in its operative position inside said dedicated volume. Complementary snap-fitting means and/or sliding means and/or fixing means can be normally be provided in the Medium Voltage switching device intended to house the auxiliary/control switches kit box of the present invention.

In a further aspect, the present invention also relates to a Medium Voltage switching device, in particular a Medium Voltage contactor, more in particular a Medium Voltage contactor comprising an auxiliary/control switches kit box as described herein.

Medium Voltage switching device are well known in the art and will not be described in details. They generally have one or more movable contacts which are operated between a contact open position and a contact closed position by a contact actuator which is connected to said one or more movable contacts through a kinematic chain to carry out the opening and closing operations of the Medium Voltage switching device.

In particular, examples of Medium Voltage contactors and contactor poles (e.g., Medium Voltage vacuum contactors and vacuum contactor poles) with corresponding driving actuators are described in patent applications EP16174129, EP16191442, and EP16198880, whose description is incorporated herein by reference.

Preferably, the contact actuator of the Medium Voltage contactor is a linear actuator comprising an operating element linearly moving between a contact open position and a contact closed position.

In a possible form of execution of the Medium Voltage contactor of the present invention, the contact actuator typically comprises electromagnetic means which are energized to move said one or more movable contacts from said contact open position to said contact closed position, and spring means which moves said one or more contacts from said contact closed position to said contact open position. The Medium Voltage contactor further comprises a linearly moving operating element that can be operatively coupled with the operating levers of the previously described auxiliary/control switches kit box.

In a typical execution of a Medium Voltage contactor, the contact actuator can be a linear monostable electromagnetic actuator which comprises a coil, a fixed armature and a movable plunger, where the plunger is linearly moving to actuate the opening/closing operations of the contactor and is connected to the one or more contact(s) of the contactor via the mechanical link. The Medium Voltage contactor further comprises a linearly moving operating element that is connected to the mechanical link and can be operatively coupled with the operating levers of the previously described auxiliary/control switches kit box.

In the above described cases, the operating element can advantageously comprise a number of slots into which said one or more operating levers are inserted to operatively connect the auxiliary/control switches kit box to the Medium Voltage contactor.

Further features and advantages of the invention will emerge from the description of preferred, but not exclusive embodiments of an auxiliary/control switches kit box and a Medium Voltage switching device, according to the invention, non-limiting examples of which are provided in the attached drawings, wherein.

Figure 1:
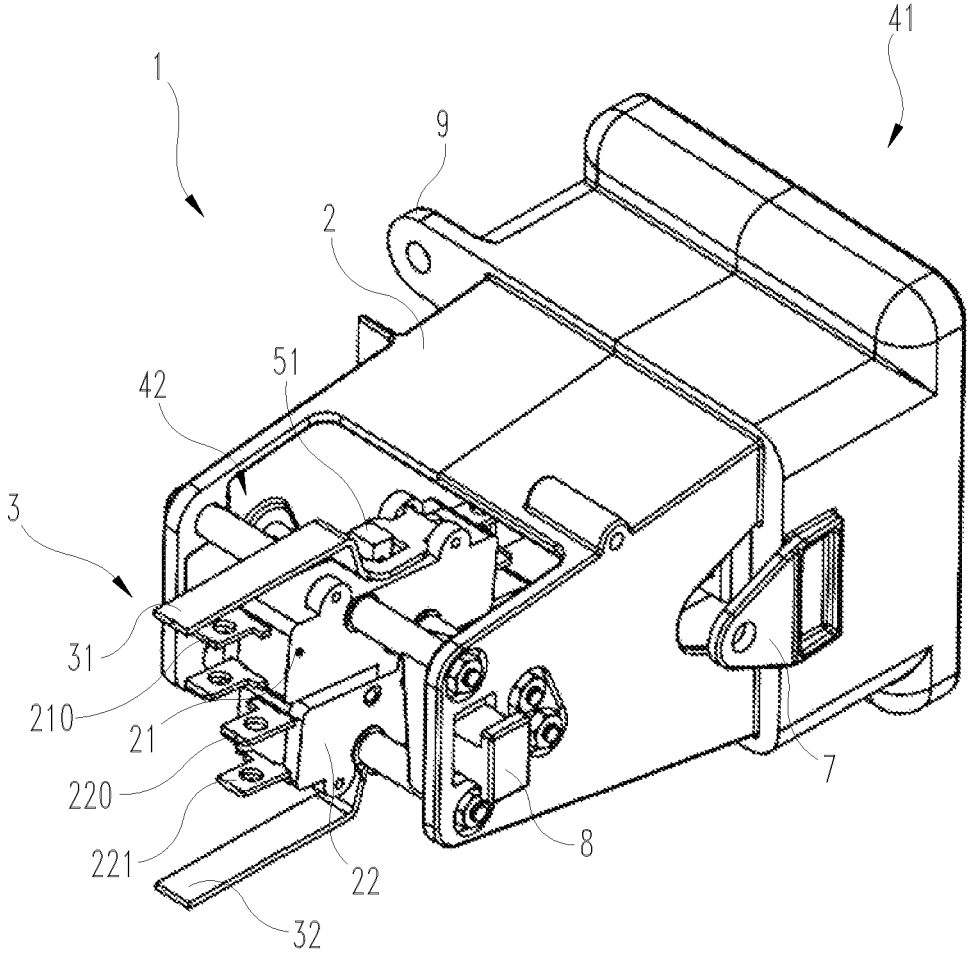
FIG. 1 is a perspective view of a first embodiment of an auxiliary/control switches kit box according to the invention.

With reference to the attached Figures, an auxiliary/control switches kit box according to the invention—designated by the reference numeral 1—is adapted to be used with a Medium Voltage switching device, preferably a Medium Voltage contactor or vacuum contactor-designated by the reference numeral 100.

Figure 9:
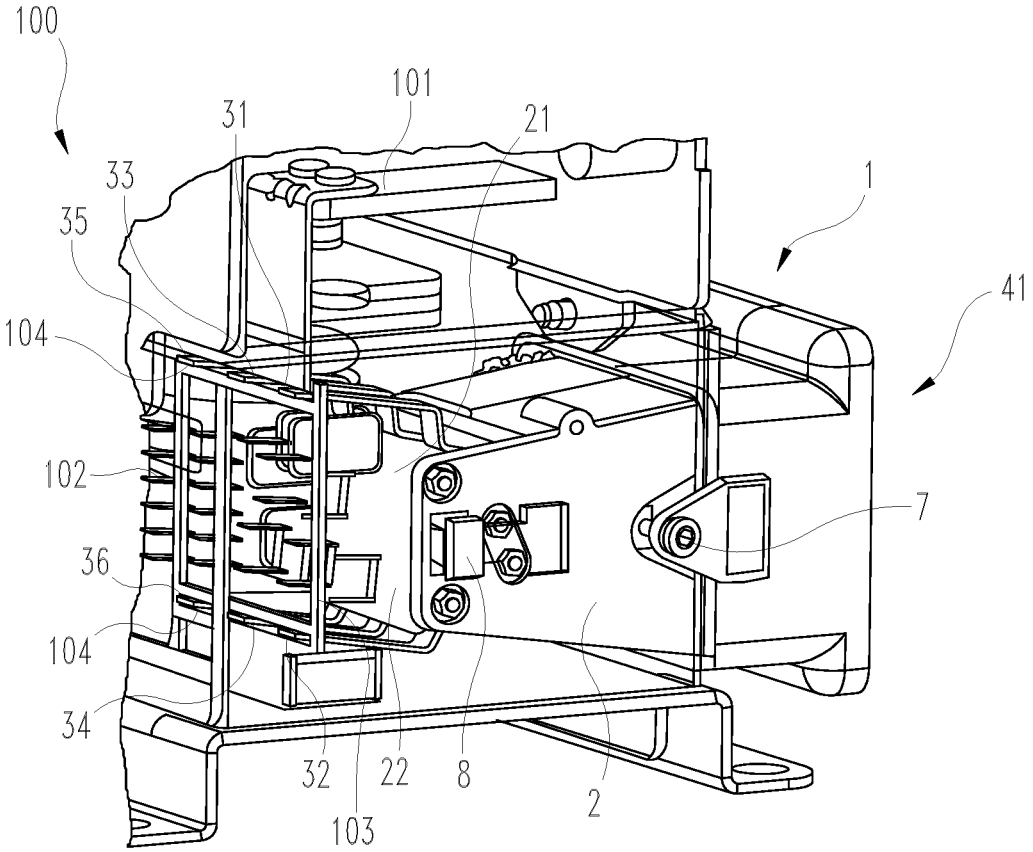
FIG. 9 is a perspective view of an auxiliary/control switches kit box according to the invention inserted into a dedicated volume inside a Medium Voltage switching device and in a first operating position.
Figure 10:
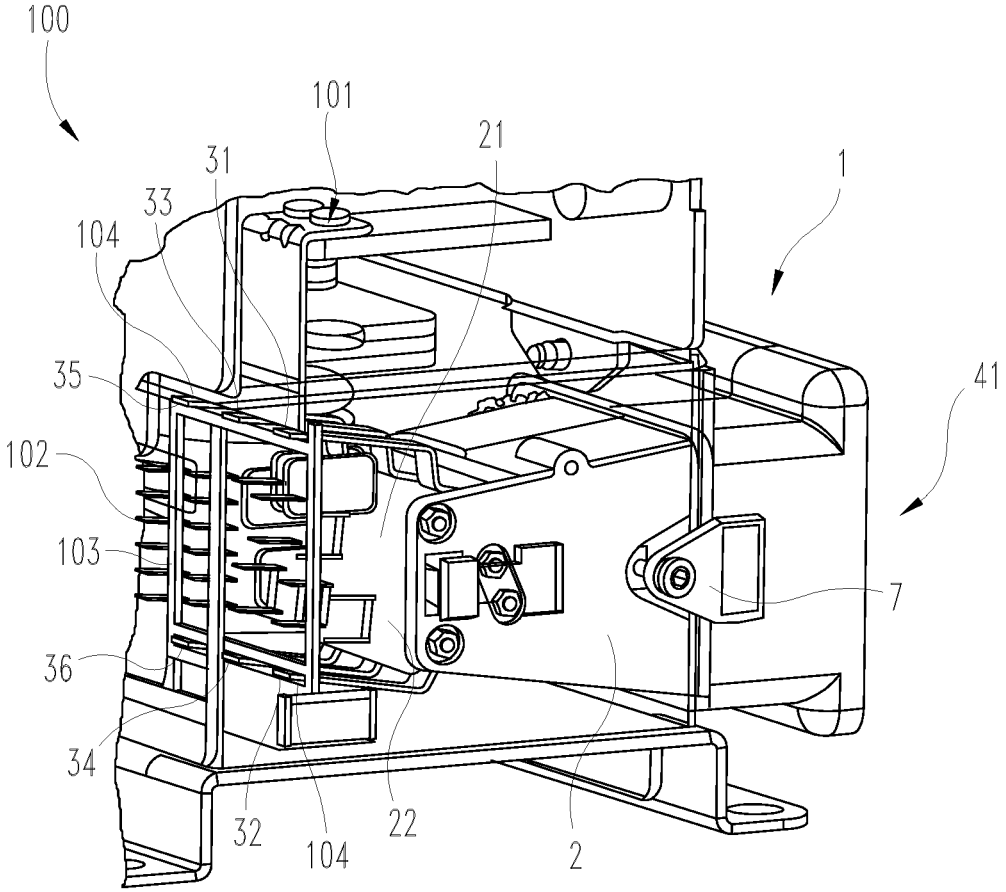
FIG. 10 is a perspective view of an auxiliary/control switches kit box according to the invention inserted into a dedicated volume inside a Medium Voltage switching device and in a second operating position.

The Medium Voltage switching device 100 generally comprises one or more movable contacts (not shown) which are operated between a contact open position (as partially shown in FIG. 9) and a contact closed position (as partially shown in FIG. 10).

Movement of the contact is generally carried out by a contact actuator 102 (only partially shown in some figures) connected to the movable contact(s) through a kinematic chain 101 (only partially shown in some figures).

The auxiliary/control switches kit box 1 according to the invention comprises in its more general definition, a shaped enclosure 2 which is adapted to be inserted into and removed from a dedicated volume 105 inside said Medium Voltage switching device 100.

Figure 2:
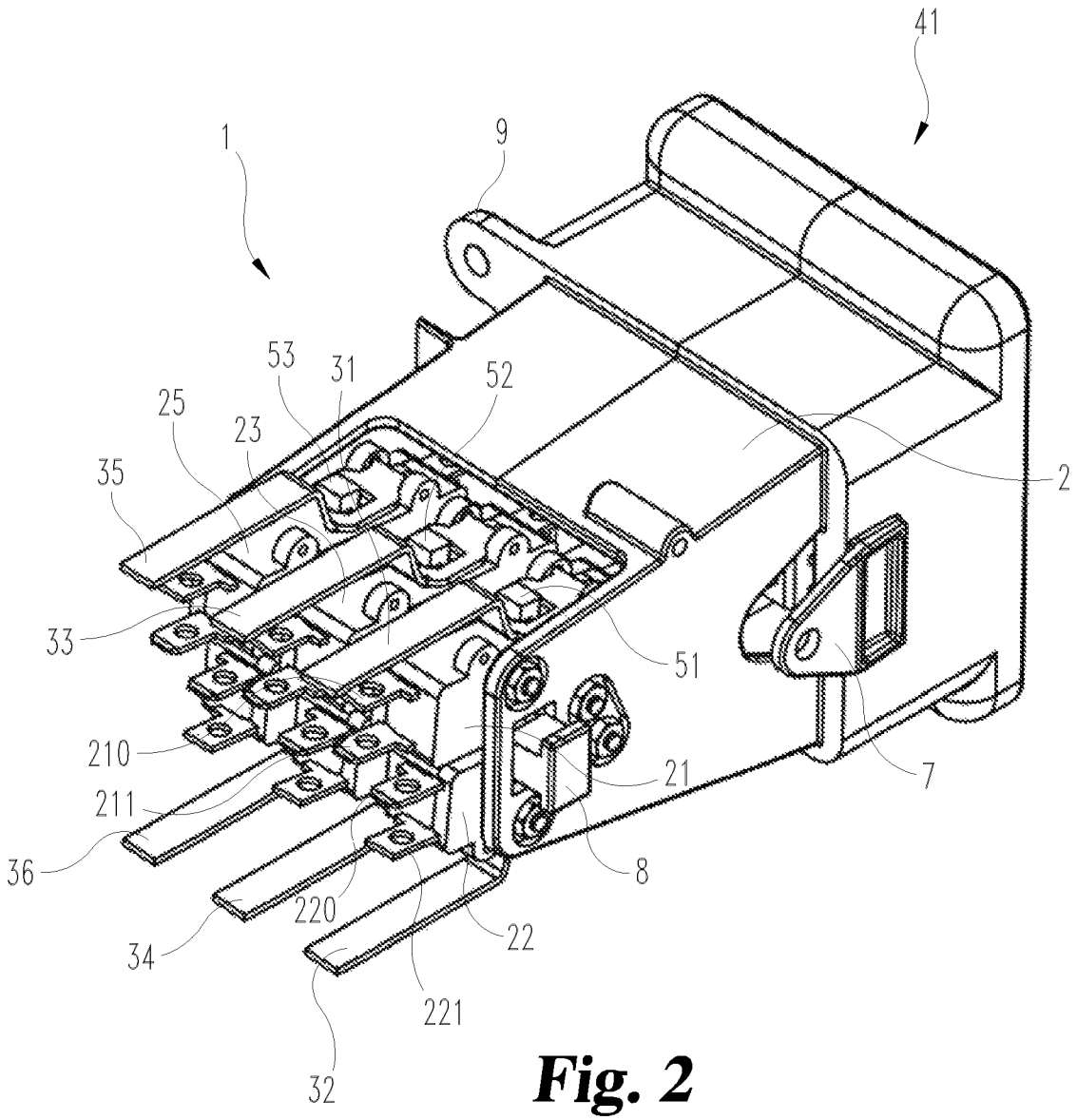
FIG. 2 is a perspective view of a second embodiment of an auxiliary/control switches kit box according to the invention.
Figure 3:
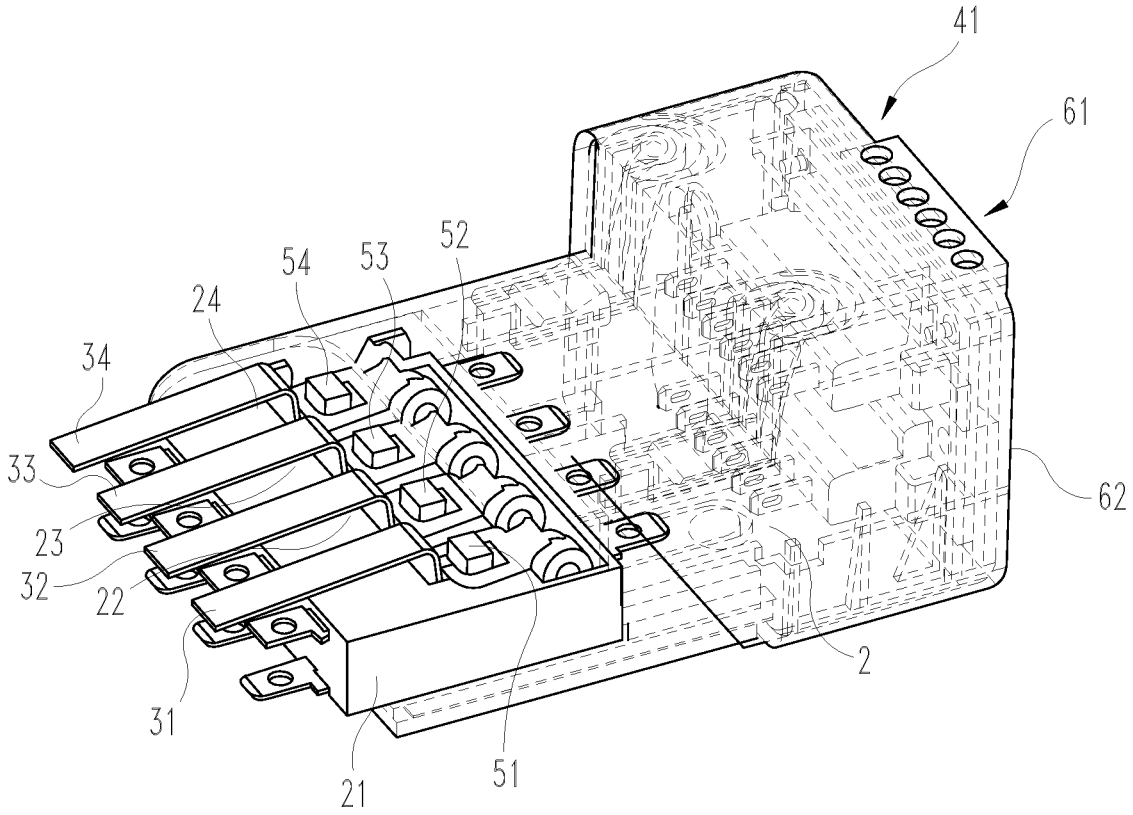
FIG. 3 is a perspective view of a third embodiment of an auxiliary/control switches kit box according to the invention.
Figure 4:
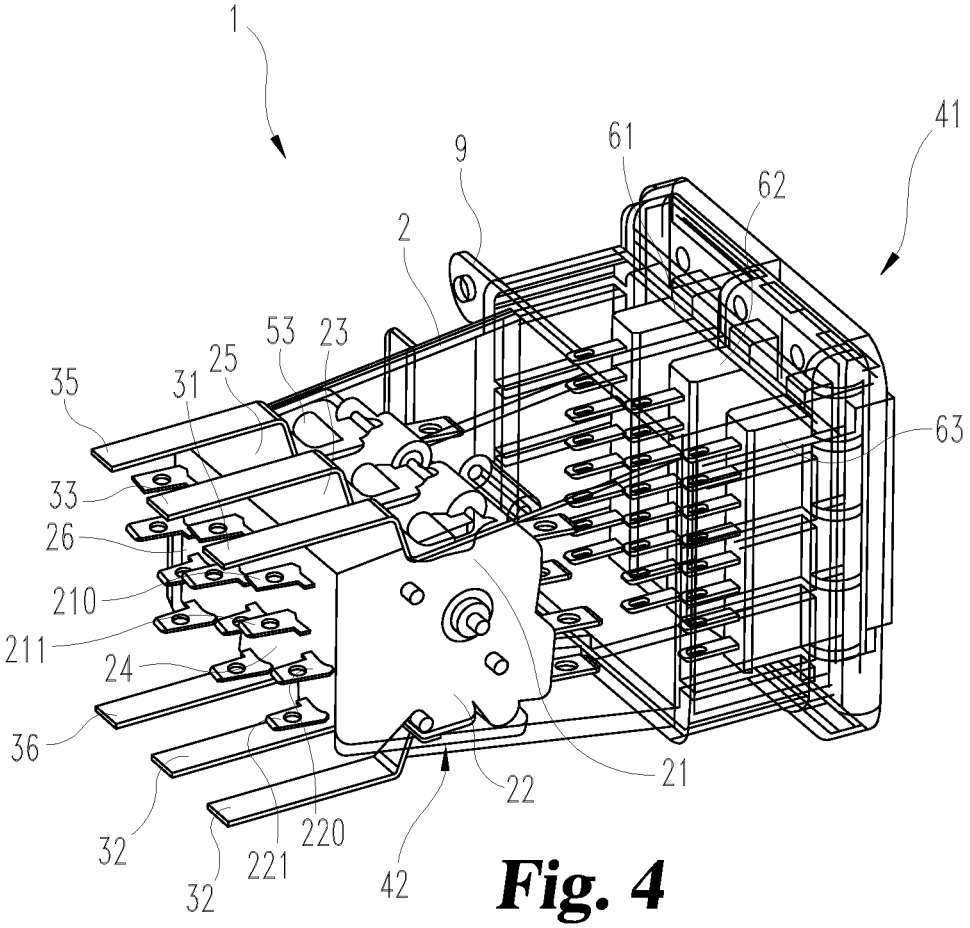
FIG. 4 is a perspective view of a fourth embodiment of an auxiliary/control switches kit box according to the invention.
Figure 5:
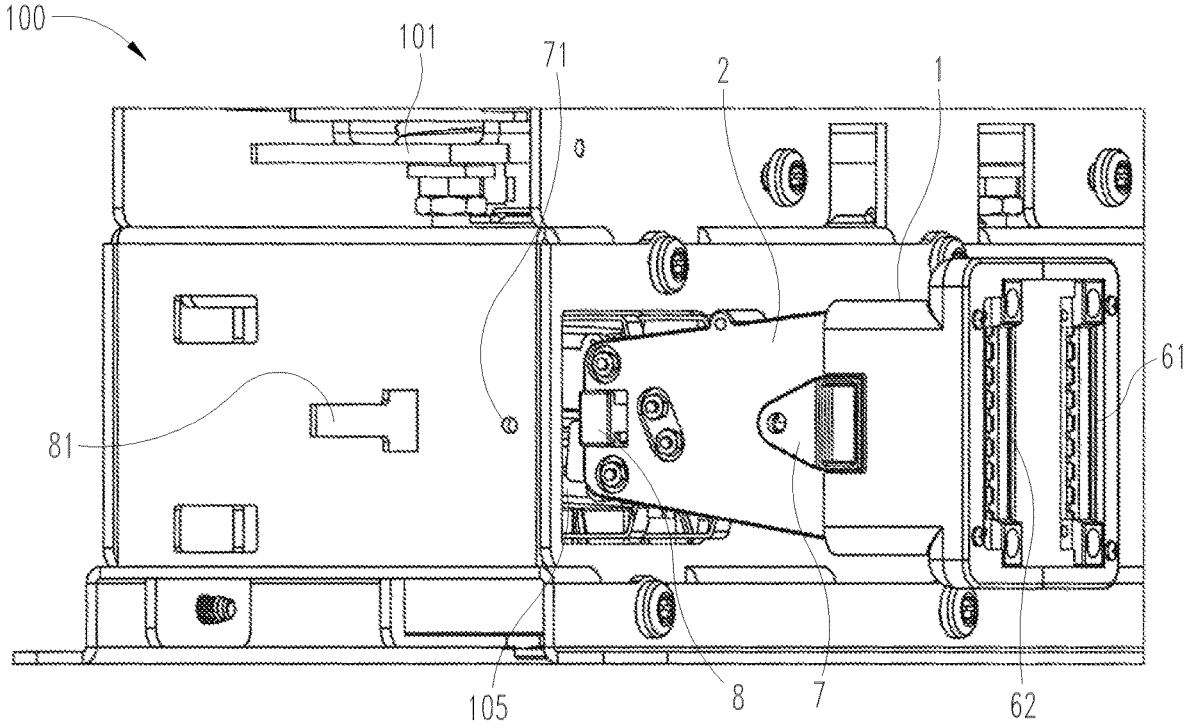
FIG. 5 is a perspective view of a first phase of the positioning of an auxiliary/control switches kit box according to the invention into a dedicated volume inside a Medium Voltage switching device.
Figure 6:
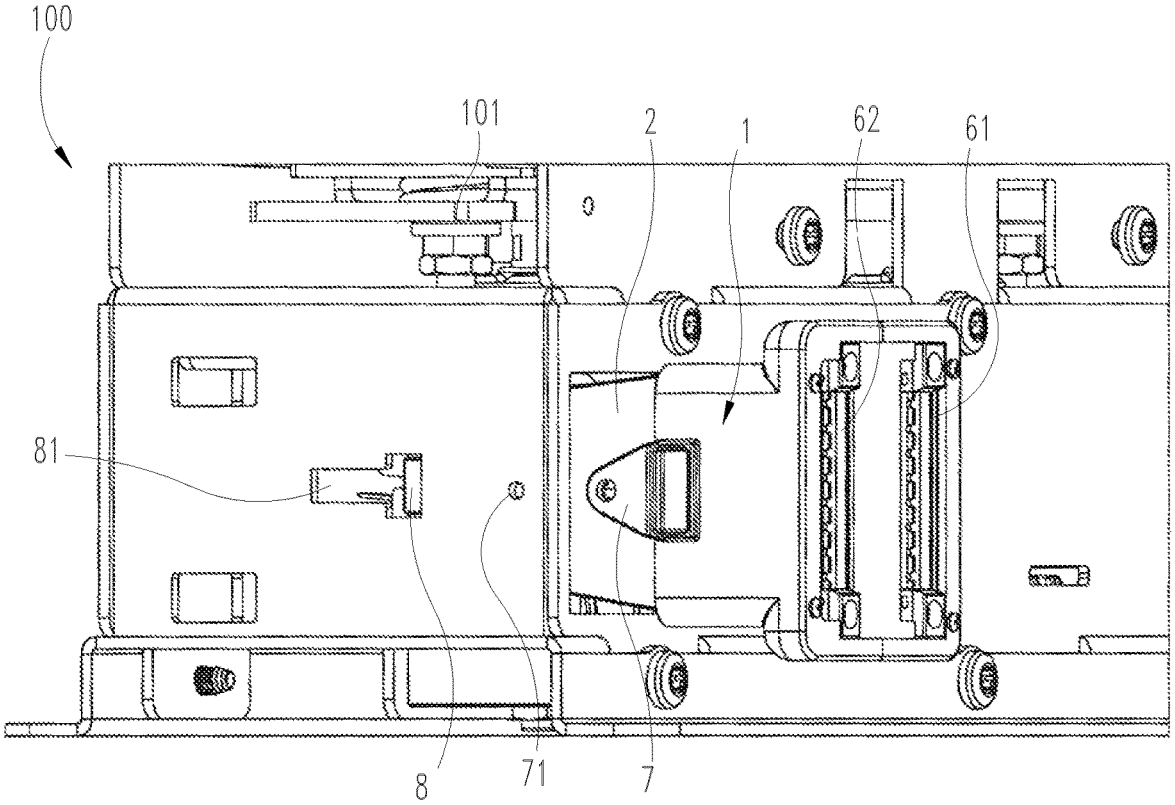
FIG. 6 is a perspective view of a second phase of the positioning of an auxiliary/control switches kit box according to the invention into a dedicated volume inside a Medium Voltage switching device.
Figure 7:
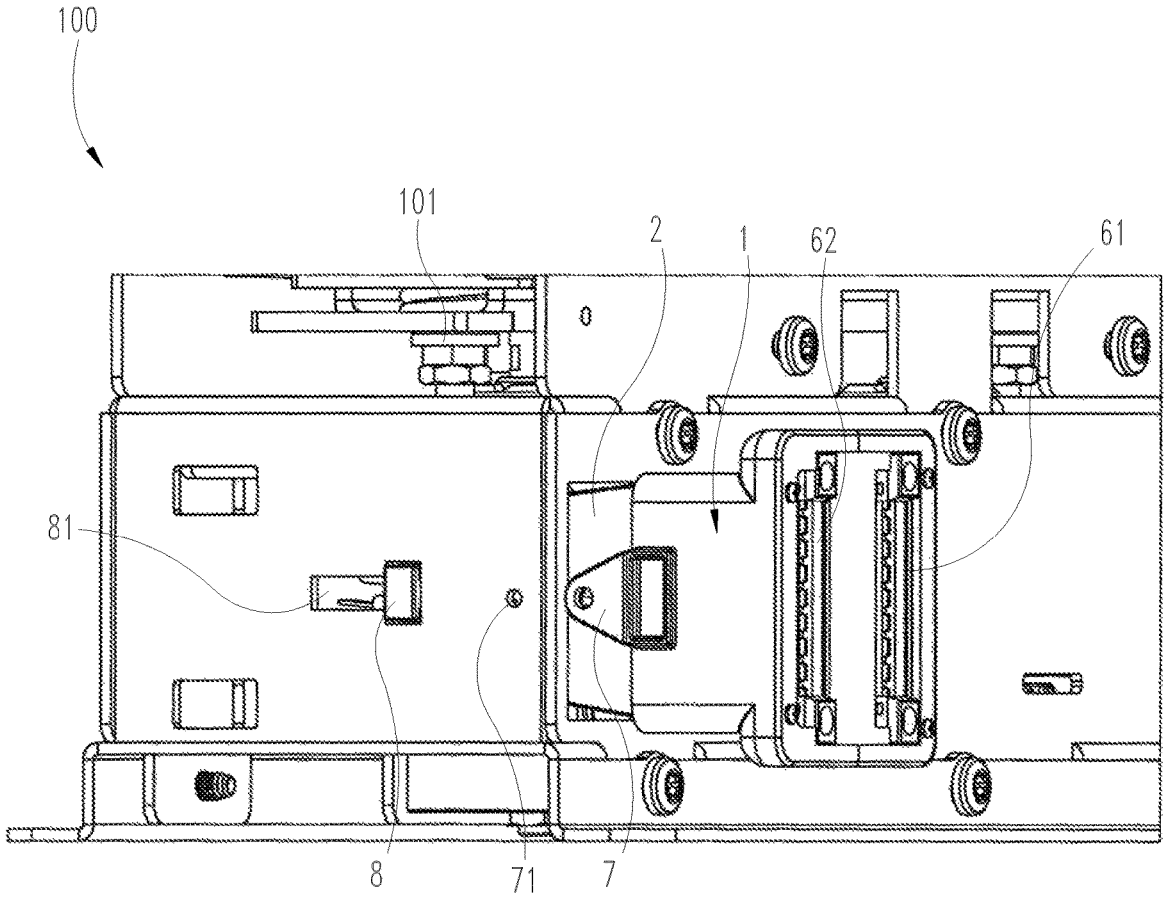
FIG. 7 is a perspective view of a third phase of the positioning of an auxiliary/control switches kit box according to the invention into a dedicated volume inside a Medium Voltage switching device.
Figure 8:
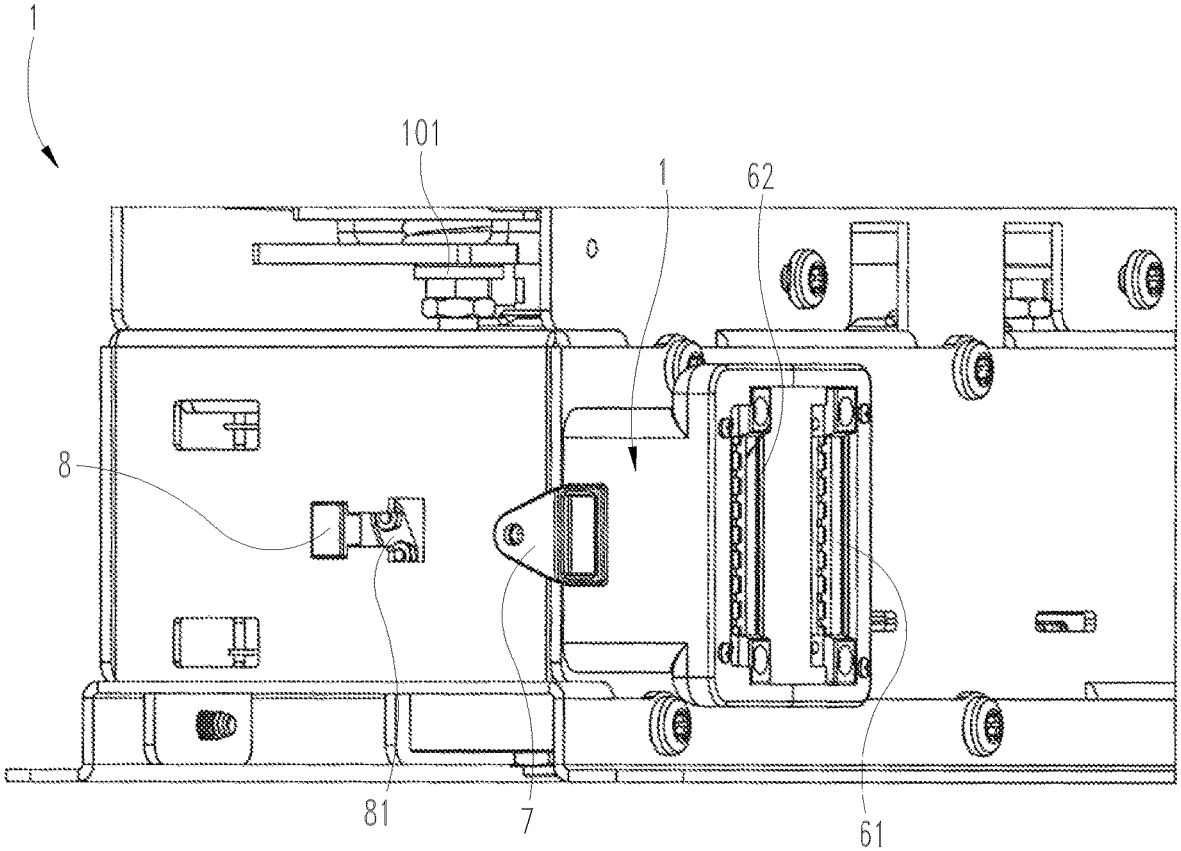
FIG. 8 is a perspective view of a fourth phase of the positioning of an auxiliary/control switches kit box according to the invention into a dedicated volume inside a Medium Voltage switching device.

The shaped enclosure 2 houses one or more auxiliary/control switches 21, 22, 23, 24, 25, 26. The number of auxiliary/control switches 21, 22, 23, 24, 25, 26 can vary depending on the needs. For instance, in the relatively simple execution of FIG. 1, only a pair of auxiliary/control switches 21, 22 is used, while in the embodiments of FIGS. 2-4, six, four and six auxiliary/control switches are respectively used.

Said auxiliary/control switches 21, 22, 23, 24, 25, 26 are electrically connected to corresponding one or more terminal boards 61, 62, 63 which provide an interface for the users. To this purpose, said one or more terminal boards 61, 62, 63 are positioned so as to face toward the outside of said shaped enclosure 2 from a first face 41 of said shaped enclosure 2.

In practice, as shown in the attached figures, when the auxiliary/control switches kit box 1 is inserted into a Medium Voltage switching device, the terminal boards 61, 62, 63 can advantageously lay on the front face of said Medium Voltage switching device and are easily accessible by an operator.

In the kit box 1 according to the invention, the auxiliary/control switches 21, 22, 23, 24, 25, 26 comprise corresponding auxiliary/control switch contacts that can be linearly operated by an auxiliary/control switch actuator 51, 52, 53 between a normally open NO position and a normally closed NC position.

The actuation of the auxiliary/control switches 21, 22, 23, 24, 25, 26 (i.e. commutation of the included NC and NO switches) is carried out by a mechanically coupling system 3 having one or more operating levers 31, 32, 33, 34, 35, 36 which protrude outside said shaped enclosure 2 from a second face 42 thereof.

The operating levers 31, 32, 33, 34, 35, 36 are connected, on one side, to a corresponding auxiliary/control switch actuators 51, 52, 53, 54 to linearly displace it between said NO position and said NC position, and on the other side, are adapted to cooperate with the kinematic chain 101 of said Medium Voltage switching device 100 and follow it during the movement from said contact open position and said contact closed position.

In this way, the one or more auxiliary/control switches 21, 22, 23, 24, 25, 26 can be positively driven by the kinematic chain 101 of said Medium Voltage switching device 100 in both directions between said normally open NO position and said normally closed NC position, with no need of return means, e.g. spring means.

According to a preferred embodiment of the kit box 1 of the present invention, said one or more auxiliary/control switches 21, 22, 23, 24, 25, 26 are double break switches or microswitches each comprising a casing 200 into which corresponding auxiliary/control switch contacts are housed. A switch or microswitch actuator 51, 52, 53, 54 is positioned on the casing 200 to drive the auxiliary/control switch contacts housed in said casing 200. Each actuator 51, 52, 53, 54 of said double break switches 21, 22, 23, 24, 25, 26 is associated with at least a corresponding operating lever 31, 32, 33, 34, 35, 36 which is connected to the kinematic chain of the Medium Voltage switching device as previously described.

For example, said one or more auxiliary/control switches are double break switches 21, 22, 23, 24, 25, 26, which are actuated by a linearly moving driving pin 51, 52, 53, 54 which is operatively connected to the auxiliary/control switch contacts and to a corresponding operating lever 31, 32, 33, 34, 35, 36.

In general, the electrical connection of the auxiliary/control switches is carried out through electrical terminals (e.g., 210, 221; 220, 221) and the whole system of said one or more auxiliary/control switches 21, 22, 23, 24, 25, 26 is advantageously pre-wired to a corresponding one or more terminal boards 61, 62, 63 before they are placed in said shaped enclosure 2.

As shown in the attached figures, claims, said first 41 face (from which the terminal boards 61, 62, 63 protrude) and second face 42 (from which the operating lever 31, 32, 33, 34, 35, 36 protrude) of said shaped enclosure 2 are substantially opposite to each other.

In a particular embodiment of the auxiliary/control switches kit box 1 of the present invention, said shaped enclosure 2 comprises snap-fitting means 7 and/or sliding means 8 and/or fixing means 9 for guiding the insertion of said auxiliary/control switches kit box 1 inside the dedicated volume 105 of said Medium Voltage switching device 100 and/or for fixing said shaped enclosure 2 in its operative position inside said dedicated volume 105.

In practice, with reference to FIGS. 5-8, the operative coupling of the takes place by linear insertion in the horizontal direction of the shaped enclosure 2 into a dedicated volume 105 inside the Medium Voltage switching device 100, with the second face 42 laying forward. In this way, the operating lever 31, 32, 33, 34, 35, 36 (which protrude from said second face 42) can be coupled with the kinematic chain 101 of said Medium Voltage switching device 100, as better described hereinafter.

At the same time, once the shaped enclosure 2 is inserted into the dedicated volume 105, the first face 41 (and consequently the terminal boards 61, 62, 63) lays on the front side of the Medium Voltage switching device 100 and is therefore easily accessible by an operator.

Insertion of the shaped enclosure 2 inside the dedicated volume 105 of said Medium Voltage switching device 100 can be made easier by using e.g. sliding means 8 adapted to slide in corresponding means (e.g. a shaped slot 81) provided in the Medium Voltage switching device 100. Similarly, fixing can be carried out by using snap-fitting means 7 and/or fixing means 9 provided on the surface of the shaped enclosure 2 and/or on tabs protruding therefrom, adapted to be coupled with complementary snap-fitting and/or fixing means 71, 91, provided in the Medium Voltage switching device 100.

In a further aspect, the present invention also relates to a Medium Voltage switching device 100 comprising an auxiliary/control switches kit box 1 as described in the present disclosure.

In particular, the present invention also relates to a Medium Voltage contactor, e.g. a vacuum contactor, 100 comprising an auxiliary/control switches kit box 1 as described in the present disclosure.

In such a case, with reference to the attached FIGS. 9 and 10, a Medium Voltage contactor, e.g. a vacuum contactor, 100 generally comprises one or more movable contacts which are operated between a contact open position and a contact closed position by a contact actuator 102 which is connected to said one or more movable contacts through a kinematic chain 101 to carry out the opening and closing operations of the Medium Voltage switching device.

In the embodiment of a Medium Voltage contactor 100 shown in the attached FIGS. 9 and 10, the contact actuator 102 is a linear monostable electromagnetic actuator which comprises a coil, a fixed armature and a movable plunger, where the plunger is linearly moving to actuate the opening/closing operations of the contactor and is connected to the one or more contact(s) of the contactor via the mechanical link 101.

The Medium Voltage contactor 100 further comprises a linearly moving operating element 103 that is connected to the mechanical link 101 and is operatively coupled with the operating levers 31, 32, 33, 34, 35, 36 of the previously described auxiliary/control switches 21, 22, 23, 24, 25, 26 of the kit box 1.

In the embodiment shown, the auxiliary/control switches 21, 22, 23, 24, 25, 26 are positioned on two superimposed rows of auxiliary/control switches pairs (first row: switches 21, 23 25; second row: switches 22, 24, 26). Different numbers and different layouts for the auxiliary/control switches 21, 22, 23, 24, 25, 26 are also possible according to the needs.

In the present embodiment, the operating element 103 is rigidly fixed to the mechanical link 101 and follows it in its linear moving between the contact open position (FIG. 9) and the contact closed position (FIG. 10).

As shown in FIGS. 9 and 10 in this possible embodiment, the operating element 103 connected to the mechanical link 101 of the contact actuator 102 comprises a two parallel slots 104 spaced apart in the vertical direction. The operating levers 31, 33, 35 of the first row of switches 21, 23, 25 are inserted in the upper slot, while the operating levers 32, 34, 36 of second row of switches 22, 24, 26 are inserted in the lower slot.

Thus, as shown in FIGS. 9 and 10 when the closing operation of the contact(s) of the Medium Voltage contactor 100 is carried out, the mechanical link 101 of the Medium Voltage contactor 100 moves upward and the operating element 103 follows such movement. The ends of the operating levers 31, 32, 33, 34, 35, 36 which are inserted in a corresponding slot 104 of the operating element 103 are also forced to move upwardly and transmit the motion to the corresponding auxiliary/control switch actuator 51, 52, 53, 54 connected to the other end of the operating levers 31, 32, 33, 34, 35, 36, thereby commuting the switches 21, 22, 23, 24, 25, 26 of the auxiliary/control switches kit box 1.

The opposite sequence takes place when the contact(s) of the Medium Voltage switching device 100 are moved from the closed position to the open position.

Depending on the needs, different layouts of the operating element 103 and different ways of coupling it with the operating levers 31, 32, 33, 34, 35, 36 of the switches 21, 22, 23, 24, 25, 26 can be devised.

Several variations can be made to the auxiliary/control switches kit box for a Medium Voltage switching device and to the Medium Voltage switching device thus conceived, all falling within the scope of the attached claims. In practice, the materials used and the contingent dimensions and shapes can be any, according to requirements and to the state of the art.

The invention claimed is:

1. An auxiliary/control switches kit box for a Medium Voltage switching device comprising one or more movable contacts operated between a contact open position and a contact closed position by a kinematic chain connected to a contact actuator, the auxiliary/control switches kit box comprising:

a shaped enclosure adapted to be inserted at least partially into and removed from a dedicated volume inside said Medium Voltage switching device;

said shaped enclosure housing one or more auxiliary/control switches electrically connected to corresponding one or more terminal boards;

said one or more terminal boards facing toward the outside of said shaped enclosure from a first face of said shaped enclosure;

said one or more auxiliary/control switches each comprising a pair of auxiliary/control switch contacts that are linearly operated by an auxiliary/control switch actuator between a normally open (NO) position and a normally closed (NC) position;

the auxiliary/control switches kit box further comprising a mechanical coupling system having one or more operating levers mechanically connected to respective ones of said auxiliary/control switch actuators within said shaped enclosure to linearly displace said respective auxiliary/control switch actuator between said NO position and said NC position; and said one or more operating levers protruding outside said shaped enclosure from a second face thereof and being adapted to cooperate with the kinematic chain of said Medium Voltage switching device and follow it during the movement from said contact open position and said contact closed position.

2. The auxiliary/control switches kit box, according to claim 1, wherein said first and second face of said shaped enclosure are substantially opposite to each other.

3. The auxiliary/control switches kit box, according to claim 1, wherein said shaped enclosure houses a set of two or more linearly actuated auxiliary/control switches.

4. The auxiliary/control switches kit box, according to claim 1, wherein said shaped enclosure comprises snap-fitting means and/or sliding means and/or fixing means for guiding the insertion of said auxiliary/control switches kit box inside the dedicated volume of said Medium Voltage switching device and/or for fixing said shaped enclosure in its operative position inside said dedicated volume.

5. The auxiliary/control switches kit box, according to claim 1, wherein said one or more auxiliary/control switches are pre-wired to a corresponding one or more terminal boards before they are placed in said shaped enclosure.

6. The auxiliary/control switches kit box, according to claim 1, wherein said one or more auxiliary/control switches are adapted to be positively driven by the kinematic chain of said Medium Voltage switching device in both directions between said normally open (NO) position and said normally closed (NC) position.

7. A medium Voltage switching device comprising an auxiliary/control switches kit box according to claim 1.

8. The Medium Voltage switching device, according to claim 7, comprising a Medium Voltage contactor.

9. The Medium Voltage switching device, according to claim 8, said Medium Voltage switching device comprises a contact actuator that is a linear actuator comprising an operating element linearly moving between a contact open position and a contact closed position.

10. The Medium Voltage switching device, according to claim 9, wherein an operating element of said contact actuator comprises a number of slots into which said one or more operating levers are inserted.

11. An auxiliary/control switches kit box for a Medium Voltage switching device comprising one or more movable contacts operated between a contact open position and a contact closed position by a kinematic chain connected to a contact actuator, the auxiliary/control switches kit box comprising:

a shaped enclosure adapted to be inserted at least partially into and removed from a dedicated volume inside said Medium Voltage switching device;

said shaped enclosure housing one or more auxiliary/control switches electrically connected to corresponding one or more terminal boards;

said one or more terminal boards facing toward the outside of said shaped enclosure from a first face of said shaped enclosure;

said one or more auxiliary/control switches each comprising a pair of auxiliary/control switch contacts that can be linearly operated by an auxiliary/control switch actuator between a normally open (NO) position and a normally closed (NC) position;

the auxiliary/control switches kit box further comprising a mechanical coupling system mechanically connected to said auxiliary/control switch actuators to linearly displace it between said NO position and said NC position;

said mechanically coupling system having one or more operating levers protruding outside said shaped enclosure from a second face thereof and being adapted to cooperate with the kinematic chain of said Medium Voltage switching device and follow it during the movement from said contact open position and said contact closed position, wherein said one or more auxiliary/control switches are double break switches each comprising a casing into which corresponding auxiliary/control switch contacts are housed, each of said double break switches being associated with at least a corresponding operating lever which is operatively connected through a corresponding auxiliary/control switch actuator with the auxiliary/control switch contacts housed in said casing.

12. The auxiliary/control switches kit box, according to claim 11, wherein said one or more auxiliary/control switches are double break switches, and in that said auxiliary/control switch actuator comprises a linearly moving driving pin for said auxiliary/control switch contacts which is operatively connected to said auxiliary/control switch contacts and to a corresponding operating lever.

13. The auxiliary/control switches kit box, according to claim 12, wherein said first and second face of said shaped enclosure are substantially opposite to each other.

14. The auxiliary/control switches kit box, according to claim 13, wherein said shaped enclosure houses a set of two or more linearly actuated auxiliary/control switches.

15. The auxiliary/control switches kit box, according to claim 14, wherein said shaped enclosure comprises snap-fitting means and/or sliding means and/or fixing means for guiding the insertion of said auxiliary/control switches kit box inside the dedicated volume of said Medium Voltage switching device and/or for fixing said shaped enclosure in its operative position inside said dedicated volume.

16. The auxiliary/control switches kit box, according to claim 15, wherein said one or more auxiliary/control switches are pre-wired to a corresponding one or more terminal boards before they are placed in said shaped enclosure.

17. The auxiliary/control switches kit box, according to claim 16, wherein said one or more auxiliary/control switches are adapted to be positively driven by the kinematic chain of said Medium Voltage switching device in both directions between said normally open (NO) position and said normally closed (NC) position.

18. The auxiliary/control switches kit box, according to claim 11, wherein said first and second face of said shaped enclosure are substantially opposite to each other.

19. The auxiliary/control switches kit box, according to claim 11, wherein said shaped enclosure houses a set of two or more linearly actuated auxiliary/control switches.

20. An auxiliary/control switches kit box for a Medium Voltage switching device comprising one or more movable contacts operated between a contact open position and a contact closed position by a kinematic chain connected to a contact actuator, the auxiliary/control switches kit box comprising:

a shaped enclosure adapted to be inserted at least partially into and removed from a dedicated volume inside said Medium Voltage switching device;

said shaped enclosure housing one or more auxiliary/control switches electrically connected to corresponding one or more terminal boards;

said one or more terminal boards facing toward the outside of said shaped enclosure from a first face of said shaped enclosure;

said one or more auxiliary/control switches each comprising a pair of auxiliary/control switch contacts that can be linearly operated by an auxiliary/control switch actuator between a normally open (NO) position and a normally closed (NC) position;

the auxiliary/control switches kit box further comprising a mechanical coupling system mechanically connected to said auxiliary/control switch actuators to linearly displace it between said NO position and said NC position;

said mechanically coupling system having one or more operating levers protruding outside said shaped enclosure from a second face thereof and being adapted to cooperate with the kinematic chain of said Medium Voltage switching device and follow it during the movement from said contact open position and said contact closed position, wherein said one or more auxiliary/control switches are double break switches, and in that said auxiliary/control switch actuator comprises a linearly moving driving pin for said auxiliary/control switch contacts which is operatively connected to said auxiliary/control switch contacts and to a corresponding operating lever.

* * * * *